US005168984A

United States Patent [19]

Walsh

[11] Patent Number: 5,168,984

[45] Date of Patent: Dec. 8, 1992

[54] ONE HAND MULTIPLE KEY CONTAINER

[76] Inventor: Henry D. Walsh, 85 Parsons St., Brighton, Mass. 02135

[21] Appl. No.: 773,028

[22] Filed: Oct. 8, 1991

[51] Int. Cl.[5] ..... A45C 11/32

[52] U.S. Cl. ..... 206/37.5; 70/456 R; 206/37.8; 206/38.1

[58] Field of Search ..... 206/37.1, 37.5, 37.8, 206/38.1, 37.2; 70/456 R; 24/3 K

[56] References Cited

U.S. PATENT DOCUMENTS

| | | | |
|---|---|---|---|
| 1,081,627 | 12/1913 | Reznicek | 206/37.5 |
| 1,548,155 | 8/1925 | Milbrad | 206/37.1 |
| 1,999,290 | 4/1935 | Goessling | 70/456 R |
| 2,066,033 | 12/1936 | Dahlgren | 206/38.1 |
| 2,125,354 | 8/1938 | Meier | 206/38.1 X |
| 2,130,469 | 9/1938 | Nasser | 206/37.1 |
| 2,571,609 | 10/1951 | Powell | 206/38.1 |
| 2,605,632 | 8/1952 | Lamonde | 70/456 R |
| 3,011,537 | 12/1961 | Castro | 70/456 R |
| 3,473,648 | 10/1969 | Paluzzi | 70/456 R |
| 4,307,590 | 12/1981 | Friedland | 206/37.5 X |
| 4,951,819 | 8/1990 | Gebert | 206/37.2 |

FOREIGN PATENT DOCUMENTS

| | | | |
|---|---|---|---|
| 1206556 | 12/1965 | Fed. Rep. of Germany | 206/37.1 |

*Primary Examiner*—Bryon P. Gehman

[57] ABSTRACT

Key container for holding, accessing and storing a plurality of keys and having quick and easy access and storing a plurality of keys. The key container has a key retainer to hold a plurality of keys and an axis along which a plurality of keys can move into and out of the container. Having such degrees of freedom enables the plurality to align its center of mass vectorially with the appropriate forces to bring about the orderly and effective movement of the plurality into or out of the key container.

1 Claim, 1 Drawing Sheet

ONE HAND MULTIPLE KEY CONTAINER

BACKGROUND OF THE INVENTION

The present invention pertains to key containers, and relates to a novel apparatus for quickly and easily holding, accessing and storing keys.

STATEMENT OF THE INVENTION

Key containers requiring a person to use one hand for holding the container and the other hand for maneuvering keys into or out of the container can be cumbersome to use. Also, if the container does not provide for orderly key arrangement, keys can entangle with one another and hinder quick and easy maneuverability of keys into or out of the key container. A key container that could provide for orderly arrangement of keys and utilization by one hand would be advantageous.

To understand better the nature of the present invention, a brief description of a key and a manner of retaining a key are now discussed. A key is a bilaterally surfaced body, and has a head end and a lock insert end at opposite poles of its longitudinal axis. The key is held on a key retainer, such as a key ring or chain for example, by passing the retainer so adapted through the key's retaining hole, a hole piercing both surfaces. A key so retained can rotate and shift its center of mass about the retainer. Attaching the key retainer, with the key retained thereon, onto an axis upon which it can both rotate about and translate along, provides the key with degrees of freedom that include (1) rotational degree about said retaining hole, (2) rotational degree about said translational axis, (3) and translational degree along said axis. These degrees of freedom permit the key to order its center of mass relative to said translational axis to a position enabling movement along the axis.

The present invention is a container that utilizes these degrees of freedom to facilitate accessing and storing keys. This feat is accomplished by enabling keys to position their center of mass relative to a translational axis for effective translation into or out of said container.

OBJECTIVES OF THE INVENTION

Accordingly, an objective of this invention is to allow a person to get one or more keys into and out of a key container utilizing only one hand.

Another objective of this invention is to facilitate storing and accessing of one or more keys retained by a key container.

Still another objective of this invention is to enable one or more keys to arrange or organize in an orderly fashion.

Still another objective of this invention is to enable the center of mass of one or more keys to shift to a position effective for translational movement of one or more keys along a translational axis for facilitated movement into and out of a key container.

And still another objective of this invention is to enable one or more keys to arrange or organize in an orderly fashion in order to enable effective shifting of the center of mass relative to a translational axis.

These and still further objectives will become apparent hereinafter.

SUMMARY OF THE INVENTION

A key container for holding, accessing and storing a plurality of keys that enables said plurality of keys to order its center of mass to a position relative to a translational axis effective for translational movement of said plurality of keys into or out of the key container along said translational axis. Enabling said plurality of keys to shift its center of mass is achieved by providing said plurality with rotational and translational degrees of freedom about said translational axis, and sufficient space for said plurality to shift accordingly.

DESCRIPTION OF THE PREFERRED EMBODIMENT

Figure 3:
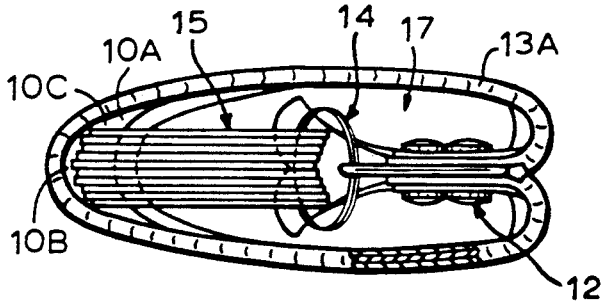
FIG. 3 is a side view of an embodiment of the invention illustrating a plurality of keys attached to a key ring and adjacent to the perimeter of the key container.
Figure 1:
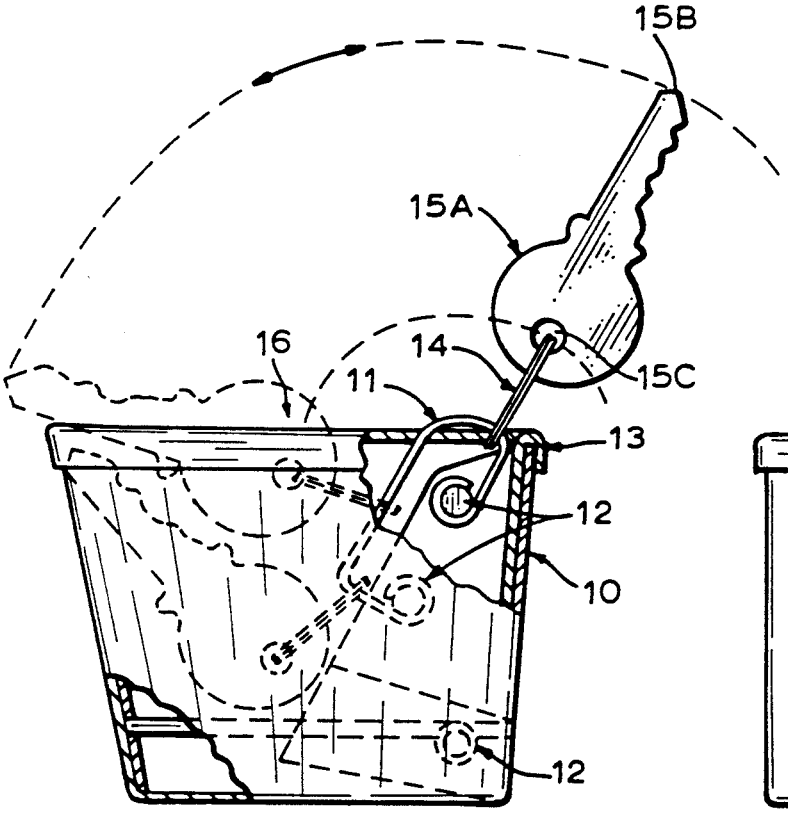
FIG. 1 is a view of one embodiment of the invention looking down onto the opening of the key container.
Figure 2:
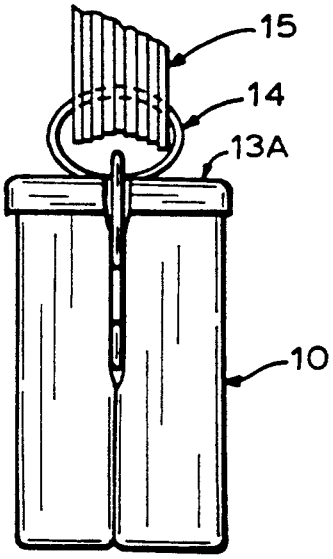
FIG. 2 is a detailed cross-sectional side view of one embodiment of the invention depicting elongated metal retainer and keys attached thereto.
Figure 4:
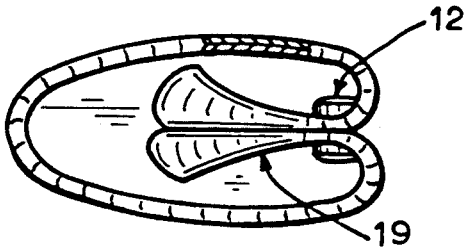
FIG. 4 is a view of one embodiment of the invention looking up from the bottom of the key container, in which a catch on which the keys may rest is depicted.

An in-depth analysis of the invention is now in order. Referring to FIG. 2 and FIG. 1, key container 10 is made of leather that is rigid enough to maintain a shape and is a single piece that is attached at its ends for form essentially a single, continuous surface (10A). Surface (10A) defines cavity (17). The ends come together by extending the ends inward to form infold (19) in cavity (17). Looped metal wire 11 is set between the ends making infold (19), the ends and looped metal wire 11 are secured together with rivet 12. Liner 13 extends around perimeter (13A). The overall dimensions of key container 10 are approximately 2⅜ inches in height, 1⅜ inches in width, and 3¼ inches in length.

Referring to FIG. 2, key ring 14 is split in order for key 15 to be fitted on it, and is looped through hole (15C) piercing key 15. Key ring 14 itself loops through looped metal wire 11. Looped metal wire 11 inclines into cavity (17) as it extends into container's 10 into cavity (17). Additionally, looped metal wire 11 is elongated longitudinally in order to provide a slide or translational axis on which key ring 14 can move along from cavity (17) to opening (16), or vice versa.

Referring to FIG. 2, when key container 10 is held with opening (16) in an upright position (when the central axis of the opening is parallel with the gravitational vector), key 15 head portion (15A) rests upon a portion of infold (19), while its lock insert end (15B) is supported by a portion of surface (10B) opposite looped metal wire 11 and infold (19), wherein head (15A) lies deeper within cavity (17) than lock insert end (15B). When key container 10 is tilted, gravity acts upon key 15 and rotates key 15 about key ring 14 away from surface portion (10B) to align key 15 in a position approximately parallel with looped metal wire 11. In this position, lock insert end (15B) rests against and is supported by surface portion (10C)—a portion of surface (10A) along which looped metal wire 11 extends. As key container 10 is further tilted, surface portion (10C) keeps key 15 positioned so that key 15 may align with a gravitational vector, which pulls upon key 15. Key 15 is pulled through opening (16) and eventually out of container 10 by pulling upon key ring 14 as key 15 moves; key ring 14 travels along looped metal wire 11 toward opening (16). As key 14 moves toward opening (16) and out of container 10, lock insert end (15B) rests upon and slides along surface portion (10C), thereby keeping key 15 aligned with the gravitational vector.

Key 15 is stored within key container 10 in a similar fashion. To store key 15, again key container 10 is held in an upright manner (with the central axis of opening (16) parallel with the gravitational vector), and key container 10 is tilted or flipped so that key 15 can travel in an arc over opening (16) toward surface portion (10C). Lock insert end (15B) contacts that portion of liner 13 covering surface portion (10C). Gravity then pulls head end (15A) through opening (16). Head end (15A) pulls upon key ring 14, which moves along looped metal wire 11 into cavity 17. Lock insert end (15B) rests against and slides along surface portion (10B) through opening (16) into cavity 17. Surface portion (10B) supports lock insert end (15B) maintains key 15 in a position so that key 15 may align with the gravitational vector for effective movement. When lock insert end (15B) contacts that portion of liner 13 covering surface portion (10C), head end (15A) rotates around key ring 14 toward surface portion (10C), and key 15 moves through opening (16) as the gravitational vector pulls head end (15A) through opening (16) into cavity (17).

It is understood by one knowledgeable in the art that the term "key retainer" signifies key retaining devices adapted to retain a key by fitting through the key's retaining hole. Examples include split key rings and key chains with detachable ends.

It is also understood by one knowledgeable in the art that the term "translational axis" signifies a physical axis for guiding the travel of an object. It includes those integral with the surface itself (i.e., a groove), as well as those attached to the surface itself (i.e., a shaft).

Further modifications of the invention herein disclosed will occur to those skilled in the respective arts and all such modifications are deemed to be within the scope of the invention as defined by the appended claims.

What is claimed is:

1. A key container comprising, an elongated, generally rectangular flexible piece of material joined upon itself to form a tubular cavity with horizontal top and bottom edges, the top perimeter of the cavity being greater in circumference than the bottom perimeter, opposite vertical ends of the piece of material being infolded into the cavity, said opposite ends being joined by rivets, a piece of metal wire disposed between the infolded ends and secured to two of said rivets at opposite ends of the wire, the wire extending, relative to the cavity, axially upwardly from a first of said two rivets to a first location, a relatively straight portion of said wire extended at an acute angle relative to the vertical axis of said cavity from said first location adjacent the vertical axis of said cavity to a second location substantially in the plane defined by the top edges of said cavity, the wire continuing on a curved portion extending above the said plane from said second location to a third location also substantially in said plane, and the wire then extending axially downwardly to the second of said two rivets, a key ring joined to the wire and at least one key having a hole therein with said key ring engaging each hole to secure each key to the wire, whereby the at least one key may be disposed within the cavity and may be removed from the cavity and then redisposed within the cavity by one-handed motion of the key container.

* * * * *